US007828170B2

(12) United States Patent
Cohen

(10) Patent No.: US 7,828,170 B2
(45) Date of Patent: Nov. 9, 2010

(54) RIM-MOUNTED DRINKING AID FOR LIQUID CONTAINERS

(76) Inventor: Elijah G. Cohen, One Carnation Ct., Mount Laurel, NJ (US) 08054

( * ) Notice: Subject to any disclaimer, the term of this patent is extended or adjusted under 35 U.S.C. 154(b) by 1317 days.

(21) Appl. No.: 11/144,895

(22) Filed: Jun. 3, 2005

(65) Prior Publication Data

US 2006/0273094 A1 Dec. 7, 2006

(51) Int. Cl.
*A47G 19/22* (2006.01)
*B65D 1/40* (2006.01)

(52) U.S. Cl. ..... 220/716; 220/703; 220/733

(58) Field of Classification Search ..... 220/716, 220/703, 710, 733, 718, 717
See application file for complete search history.

(56) References Cited

U.S. PATENT DOCUMENTS

| | | | | | |
|---|---|---|---|---|---|
| 381,795 | A | | 4/1888 | Kimball | |
| 927,892 | A | | 7/1909 | Steele, Jr. | |
| 1,161,730 | A | | 11/1915 | Reynolds | |
| 1,298,031 | A | * | 3/1919 | Fromhagen | 222/569 |
| 1,952,288 | A | | 3/1934 | Saxon | |
| 2,106,381 | A | | 1/1938 | Rough | |
| 2,550,568 | A | | 4/1951 | Kersh | |
| 2,817,465 | A | | 12/1957 | Gray | |
| 3,074,604 | A | * | 1/1963 | Baroud | 222/569 |
| 3,102,667 | A | | 9/1963 | Ullevig | |
| 3,598,278 | A | | 8/1971 | Van, Jr. | |
| 3,695,488 | A | | 10/1972 | Olsson | |
| 3,853,249 | A | | 12/1974 | Weir, Jr. et al. | |
| 3,944,112 | A | | 3/1976 | Miller | |
| 4,009,805 | A | | 3/1977 | Klygis et al. | |
| 4,243,156 | A | | 1/1981 | Lobbestael | |
| 4,299,340 | A | * | 11/1981 | Hrytzak | 222/189.07 |
| 4,316,560 | A | | 2/1982 | Carter | |
| 4,369,890 | A | * | 1/1983 | Bennett | 220/733 |
| 4,509,665 | A | | 4/1985 | Goodall | |
| D283,492 | S | * | 4/1986 | Nitsch | D9/436 |
| 4,813,579 | A | | 3/1989 | Ciumaga | |
| D322,221 | S | * | 12/1991 | Neff | D9/435 |
| 5,169,040 | A | * | 12/1992 | Wiley | 222/571 |
| 5,195,662 | A | * | 3/1993 | Neff | 222/108 |
| 5,234,133 | A | | 8/1993 | Kensey | |
| D373,050 | S | | 8/1996 | Brewer et al. | |
| 5,651,481 | A | | 7/1997 | Jensen | |
| 5,702,024 | A | | 12/1997 | Riso | |

(Continued)

*Primary Examiner*—Anthony Stashick
*Assistant Examiner*—Shawn M Braden
(74) *Attorney, Agent, or Firm*—Stradley Ronon Stevens & Young, LLP

(57) ABSTRACT

A drinking aid adapted to engage, and facilitate drinking by a user from, a liquid container having a rim and an opening. The drinking aid has a body at least a portion of which defines a U-shaped groove adapted to receive the rim of the container when the rim slips into the groove and to create a mechanical engagement between the rim and the drinking aid. The body also engages the container to create a frictional fit between the drinking aid and the container. At least one of a column or angled arms disposed on the body form a V-shaped or U-shaped funnel directing and centering fluid from the container to an orifice either formed in the column or defined by the angled arms. The drinking aid prevents spillage of the liquid from the container when the user tilts the container to pour liquid through the orifice.

19 Claims, 4 Drawing Sheets

U.S. PATENT DOCUMENTS 5,749,491 A 5/1998 Wylder et al.
D398,813 S 9/1998 Franzese
5,823,384 A 10/1998 Sartori de Zamparolo
6,189,725 B1 * 2/2001 Monico ..... 220/698
D456,259 S 4/2002 Groenwald
6,637,616 B2 10/2003 Couto

* cited by examiner

RIM-MOUNTED DRINKING AID FOR LIQUID CONTAINERS

TECHNICAL FIELD

The present invention relates generally to liquid containers or vessels having rims surrounding a large opening and, more particularly, to an aid adapted to engage the rim and enable the user to drink liquid from the container.

BACKGROUND OF THE INVENTION

When a child finishes the cereal in his or her breakfast bowl, milk often remains in the bowl. The child would like to drink, or "slurp," the remaining milk. To do so, the child tilts the bowl to his or her mouth. This action typically causes spillage, because the milk exits the bowl both into and not into the child's mouth. Adults face a similar dilemma when they attempt to drink soup or other beverages from a wide-mouth bowl or other fluid container or vessel having a large opening.

A number of attachments are known to facilitate drinking of a liquid, such as water, soda, beer, or other beverages, from a conventional cup or can having a relatively small opening. The moustache cup adapter disclosed by Miller in U.S. Pat. No. 3,944,11 represents one example. The moustache cup adapter ("adapter") does not center or funnel the flow of liquid; rather, the adapter blocks and restricts flow, to protect the mustache, except for the aperture defined by opening 3. Element 1 of the adapter is a segmental-shaped, flat, thin, plastic plane without walls to direct flow.

Other devices are known to engage fluid containers or vessels having a large opening to facilitate drinking of the fluid. U.S. Pat. No. Des. 373,050 illustrates one example of such a device. Brewer et al. show a straw penetrating both the rim of the container and an upper region of the side wall of the container. One end of the straw sits adjacent the bottom of the bowl, enabling the user to drink at least most of the fluid from the container. This device requires a specially manufactured bowl: one having aligned holes in both its rim and side wall. In addition, the relatively small opening of the straw limits the amount of liquid that the device can transfer during a specified period of time and, therefore, the speed at which the user can drink.

To overcome the shortcomings of the existing devices, a new rim-mounted drinking aid for liquid containers is provided. An object of the present invention is to provide an easily manufactured drinking aid that engages conventional containers without requiring any modification to the container. A related object is to provide a drinking aid that easily slips onto the rim of a container where it is adequately held in place. Other related objects are to provide a flexible drinking aid that engages the container via a combination of spring and frictional forces and a drinking aid constructed so that it conforms to and fits tightly on the rim of the container.

Still other objects of the present invention are to provide an effective seal with the associated container and to prevent spillage when the user drinks from the container. An additional object is to provide a drinking aid that centers or funnels the flow of liquid from the container and toward the mouth of the user. Yet another object is to permit rapid, substantially spill-free transfer of large quantities (certainly relative to conventional straws) of liquid from a container.

It is still another object of the present invention to assure that the drinking aid can be easily removed from the container, cleaned, and reused. An additional object is to render the drinking aid readily adaptable for use with containers of slightly different size, and able to readily conform to irregularities in the configuration of the container.

SUMMARY OF THE INVENTION

To achieve these and other objects, and in view of its purposes, the present invention provides a drinking aid adapted to engage, and facilitate drinking by a user from, a liquid container having a rim and an opening. The drinking aid has a body at least a portion of which defines a U-shaped groove adapted to receive the rim of the container when the rim slips into the groove and to create a mechanical engagement between the rim and the drinking aid. The body also engages the container to create a frictional fit between the drinking aid and the container. At least one of a column or angled arms disposed on the body form a V-shaped or U-shaped funnel directing and centering fluid from the container to an orifice either formed in the column or defined by the angled arms. The drinking aid prevents spillage of the liquid from the container when the user tilts the container to pour liquid through the orifice.

The present invention also encompasses a kit. The kit includes two components. The first component is a liquid container having a rim and an opening. The second component is the drinking aid as defined above.

In one specific embodiment, the invention is a drinking aid adapted to engage, and facilitate drinking by a user from, a liquid container having a rim, an outside wall, and an opening. The drinking aid has a body defining a U-shaped groove adapted to receive the rim of the container when the rim slips into the groove and to create a mechanical engagement between the rim and the drinking aid, the body also engaging the container to create a frictional fit between the drinking aid and the container. A leg of the drinking aid extends downward from the body and is adapted to engage the outside wall of the container to stabilize the drinking aid on the container. A neck extends upward from the body and transitions to a column that forms a V-shaped or U-shaped funnel directing and centering fluid from the container to an orifice centrally formed by angled sides in the column. A curved lip is disposed on the end of the column opposite the neck, the lip helping to prevent spillage of the liquid from the container when the user tilts the container to pour liquid out the opening and through the orifice.

It is to be understood that both the foregoing general description and the following detailed description are exemplary, but are not restrictive, of the invention.

BRIEF DESCRIPTION OF THE DRAWING

The invention is best understood from the following detailed description when read in connection with the accompanying drawing. It is emphasized that, according to common practice, the various features of the drawing are not to scale. On the contrary, the dimensions of the various features are arbitrarily expanded or reduced for clarity. Included in the drawing are the following figures.

DETAILED DESCRIPTION OF THE INVENTION

Figure 1:
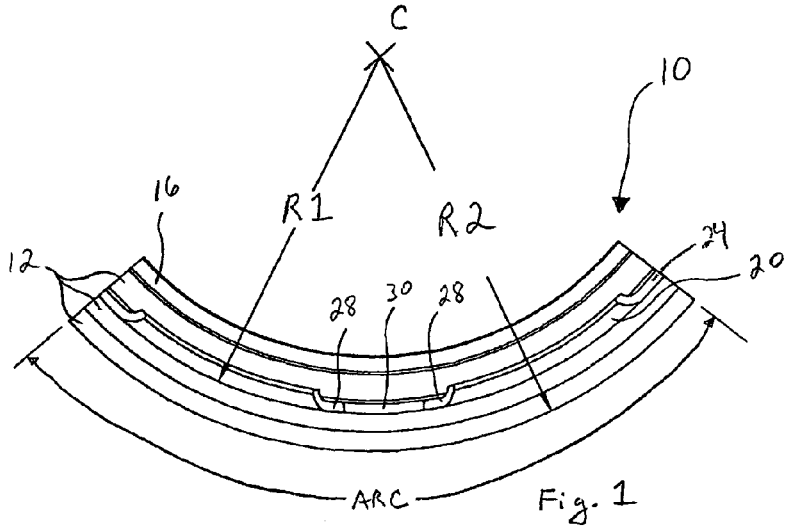
FIG. 1 is a top view of a first embodiment of the drinking aid according to the present invention.
Figure 11:
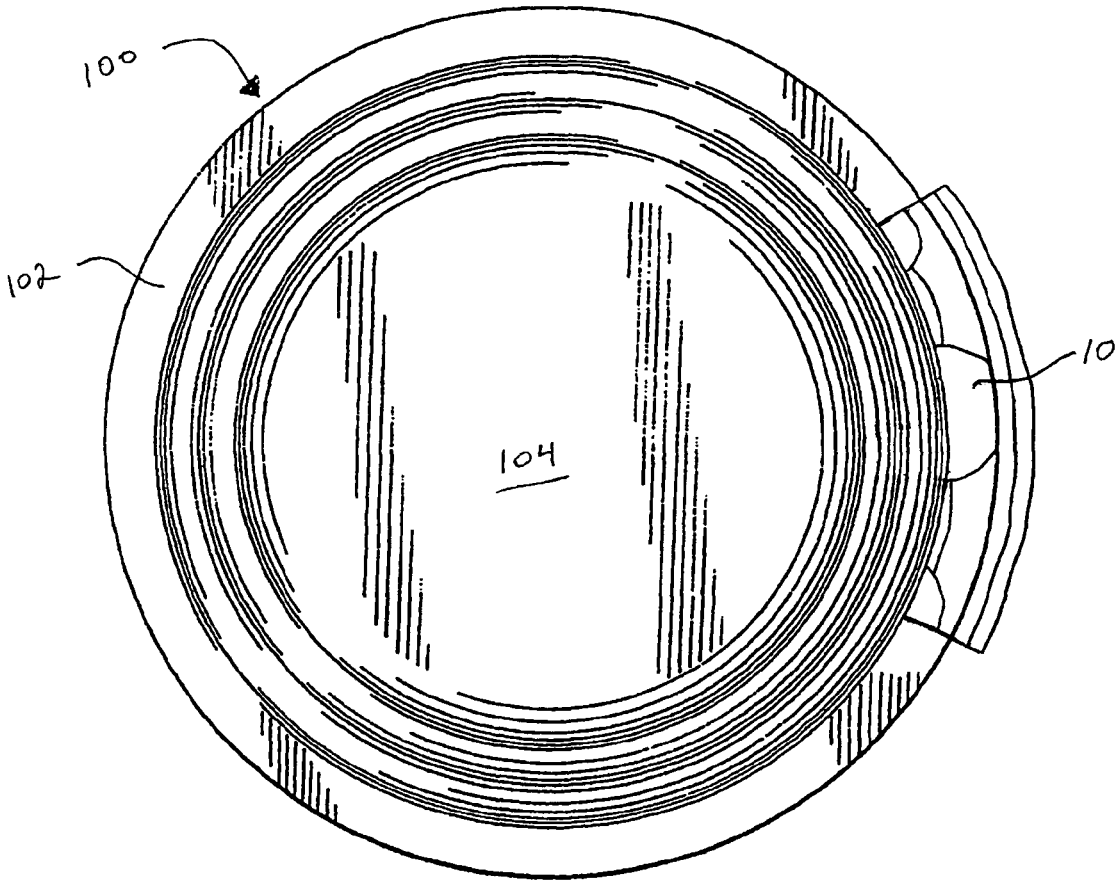
FIG. 11 is a top view of a conventional liquid container with the first embodiment of the drinking aid in position on the rim of the container according to the present invention.
Figure 12:
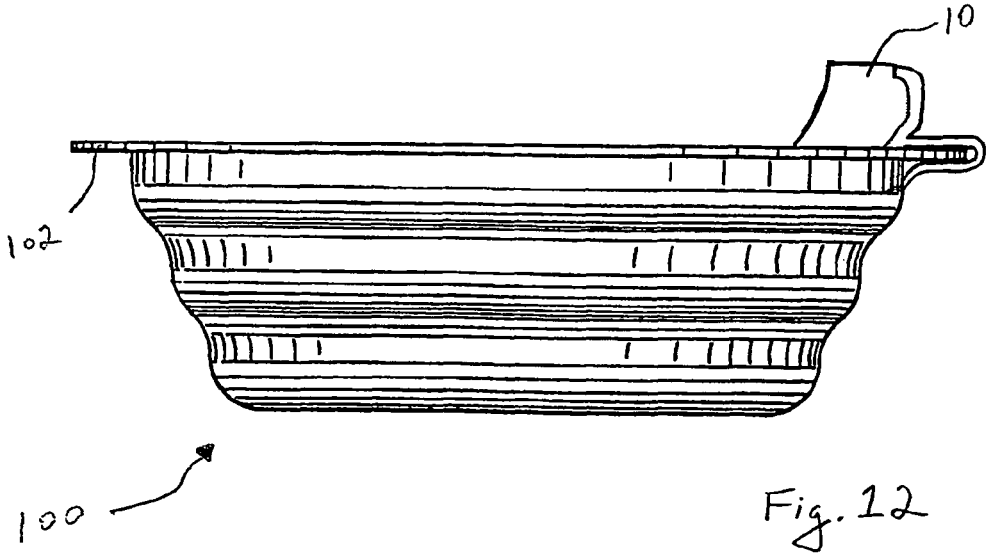
FIG. 12 is a side view of the liquid container and drinking aid as shown in FIG. 11.

Referring now to the drawing, in which like reference numbers refer to like elements throughout the various figures that comprise the drawing, FIG. 1 shows a top view of a first embodiment of the drinking aid 10 according to the present invention. Although it may be sized to fit any conventional liquid container 100 having a rim 102 surrounding a large opening 104, as shown in FIGS. 11 and 12, a typical length for drinking aid 10 is about 4 inches. Container 100 may be any conventional china, glassware, or paper serving vessel. Examples of container 100 include bowls, cups, or other receptacles, and especially include beverage or other liquid containers.

Drinking aid 10 is molded from plastic as one, integral, monolithic, unit. A non-toxic, recyclable material such as low-density polyethylene is a suitable plastic material of manufacture. Although other materials are suitable, the material of manufacture for drinking aid 10 must be resilient and flexible to allow drinking aid 10 to (1) engage rim 102 of container 100; (2) fit onto containers of various sizes; and (3) readily conform to irregularities in the configuration of container 100. The material permits drinking aid 10 to be cleaned, sterilized, or sanitized and reused (e.g., drinking aid 10 is dishwasher safe). Although a flexible plastic material is preferred, it is also possible to manufacture drinking aid 10 from a semi-hard material that fits containers of a definite size or shape. It is possible, too, to manufacture drinking aid 10 from a disposable material.

Figure 3:
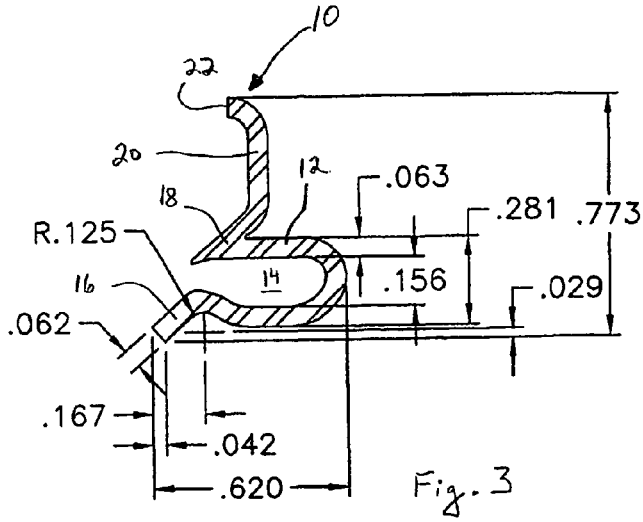
FIG. 3 is a cross-sectional view taken along the line 3-3 of FIG. 2.

Geometrically, drinking aid 10 has an annular shape adapted to correspond to that of container 100. Drinking aid 10 extends only partially around the circumference of container 100 and is typically aligned along an arc ("ARC") of about 100 degrees with a radius of curvature R2 from the annulus center C of about 2.55 inches. As most clearly illustrated in the cross section of FIG. 3, drinking aid 10 has a U-shaped body 12 defining an annular groove 14. A lower leg 16 extends downward from body 12. Projecting upward from body 12 is a neck 18, which transitions to a column 20 ending in a lip 22. Exemplary dimensions suitable for drinking aid 10 are provided in FIG. 3.

Figure 2:
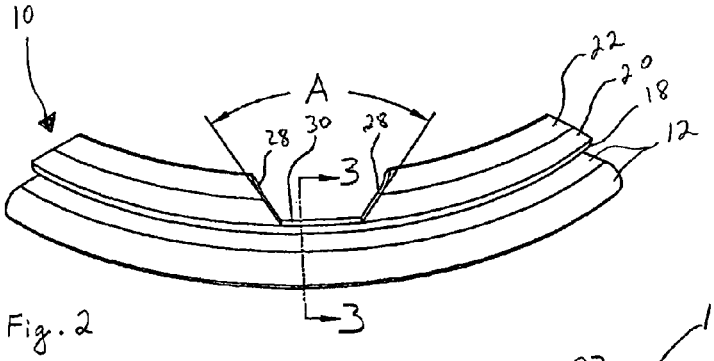
FIG. 2 is a front view of the drinking aid shown in FIG. 1.

Both ends of column 20 and lip 22 have a beveled edge 24 for comfort and ease of use. Beveled edge 24 also avoids sharp corners and the corresponding risk that drinking aid 10 might catch on other objects. Column 20 has a radius of curvature R1 from the annulus center C of about 2.31 inches. Centered in column 20 is an orifice 30 defined by angled sides 28. Angled sides 28 give orifice 30 a V-shaped funnel design, with a typical angle ("A") of about 67 degrees (see FIG. 2).

Figure 4:
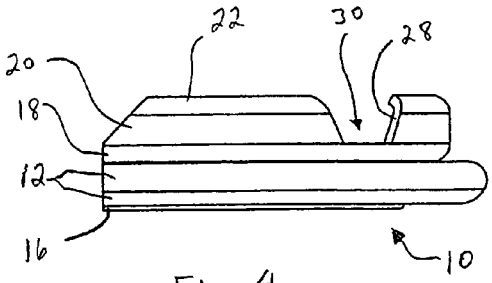
FIG. 4 is a left-side perspective view of the drinking aid shown in FIGS. 1-3.
Figure 5:
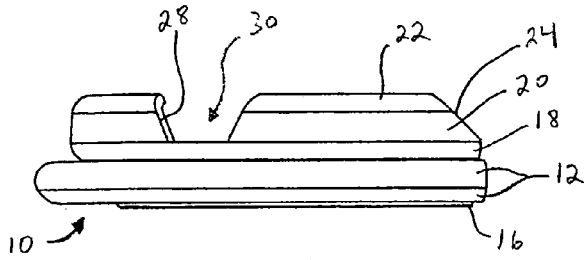
FIG. 5 is a right-side perspective view of the drinking aid shown in FIGS. 1-4.

FIGS. 4 and 5 are respectively a left-side and a right-side perspective view of drinking aid 10. These figures show that drinking aid 10 is bilaterally symmetrical about the center of orifice 30.

As illustrated in FIGS. 11 and 12, drinking aid 10 easily slips onto rim 102 of any liquid container 100. More specifically, the user grasps drinking aid 10 and pushes drinking aid 10 toward rim 102 with rim 102 aligned between leg 16 and neck 18. Given the resiliency of drinking aid 10, this action separates leg 16 from neck 18 so that rim 102 slips into groove 14. Thus, assembly of drinking aid 10 onto container 100 involves a simple sliding motion and is easily achieved. Once rim 102 is fully in position within groove 14, as shown best in FIG. 12, the user releases grasp of drinking aid 10 and is ready to enjoy the liquid in container 100. Drinking aid 10 remains in position on container 100 via (1) a friction force created by the engagement between drinking aid 10 and container 100, and (2) the spring force provided by the resiliency of drinking aid 10. Leg 16 engages the outside wall of container 100 to provide additional stability.

To drink a liquid from container 100 without drinking aid 10 is difficult because the liquid spreads out or expands as the user tilts container 100 and the liquid exits the relatively large opening 104 of the container. The user finds it difficult to center the flow of the liquid as it exits container 100. With drinking aid 10 in position on container 100, however, the liquid is centered to allow ease of drinking. Drinking aid 10 funnels the liquid to the center of drinking aid 10 where the liquid passes through orifice 30 and to the mouth of the user; drinking aid 10 creates a funnel to direct fluid flow.

The V-shaped design includes relatively high angled sides 28 of column 20 on each side of orifice 30 to prevent spillage from liquid-holding container 100 as the user drinks. The curvature of lip 22 also helps to prevent spillage. Drinking aid 10 provides a liquid seal when assembled onto rim 102 of container 100, allowing liquid to funnel to V-shaped orifice 30 and preventing leakage between drinking aid 10 and rim 102 of container 100. Thus, drinking aid 10 constitutes a spill-resistant, rim-mounted, pouring spout for container 100.

After the user has finished drinking the liquid from container 100, drinking aid 10 can be removed from container 100, cleaned, and reused. The user simply grasps drinking aid 10 and peels it away from rim 102 of container 100. A relatively slight pull force exerted by the user will overcome the friction and spring forces that otherwise maintain drinking aid 10 on container 100. As the user pulls on drinking aid 10, leg 16 and neck 18 expand and allow rim 102 to exit groove 14. Once drinking aid 10 is completely removed from container 100, drinking aid 10 can be cleaned along with other dishes—perhaps in a dishwasher. Thereafter, drinking aid 10 is ready to be reused.

Figure 6:
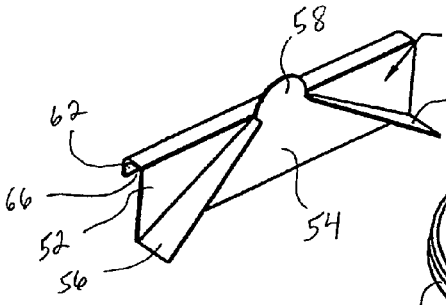
FIG. 6 is an isometric view of a second embodiment of the drinking aid according to the present invention, shown before application to a liquid container.
Figure 7:
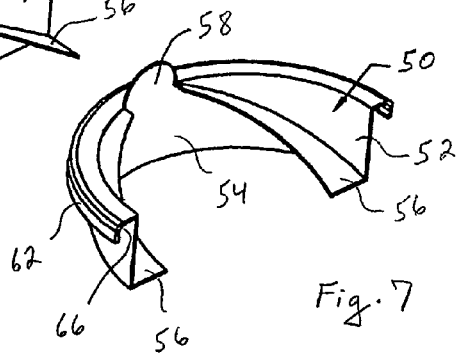
FIG. 7 is an isometric view of the drinking aid shown in FIG. 6, shown as it is shaped upon application to a liquid container.

FIGS. 6-10 illustrate a second embodiment, namely the drinking aid 50, according to the present invention. More specifically, FIG. 6 illustrates drinking aid 50 before application to container 100. Drinking aid 50 has a substantially flat body 52 with a front face 54. Provided on front face 54 are a pair of angled arms 56 creating a funnel that ends in a tongue 58 at an orifice 60.

Figure 8:
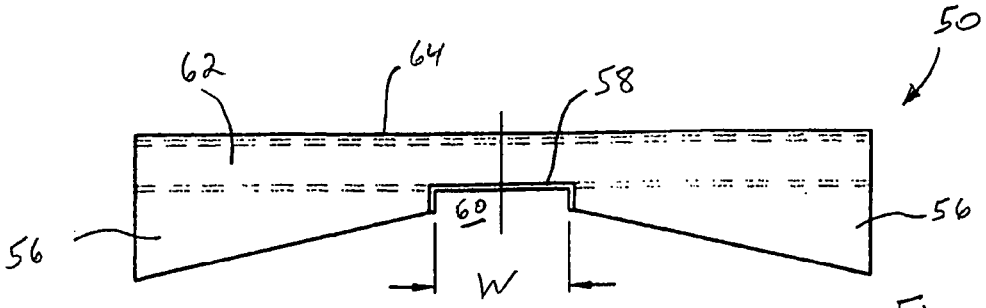
FIG. 8 is top view of the drinking aid shown in FIGS. 6 and 7.
Figure 9:
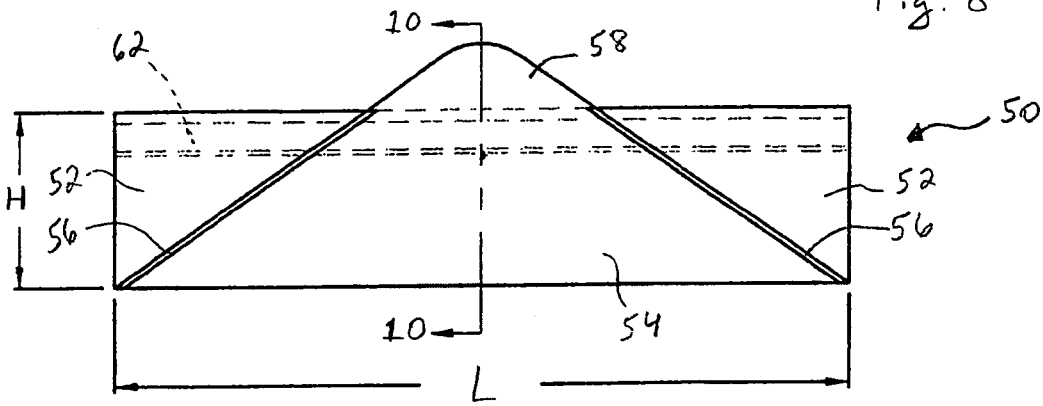
FIG. 9 is a front view of the drinking aid shown in FIGS. 6, 7, and 8.
Figure 10:
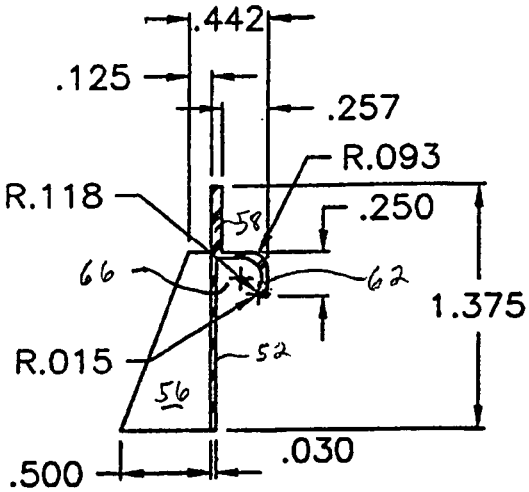
FIG. 10 is a cross-sectional view taken along the line 10-10 of FIG. 9.

As shown best in FIG. 8, a typical width ("W") for orifice 60 is between 0.50 and 1.0 inches and, preferably, about 0.75 inches. Such a width permits rapid, substantially spill-free transfer of large quantities (certainly relative to conventional straws) of liquid. FIG. 9 shows that drinking aid 50 has exemplary dimensions including a height ("H") of about 1 inch and a length ("L") of about 4 inches. Other exemplary dimensions suitable for drinking aid 50 are provided in FIG. 10. All of these dimensions can be changed, however, to accommodate different containers of particular sizes. In addition, the sizes of particular components of drinking aid 50 may be changed. For example, although the thickness as illustrated in FIG. 10 of tongue 58 is about 0.060 inches (i.e., twice the thickness of body 52), tongue 58 and body 52 may have the same thickness (e.g., 0.030 inches).

Provided at the top of body 52 and extending opposite front face 54 is an L-shaped hook 62 defining, in combination with the rear face 64 of body 52, a U-shaped annular groove 66. Hook 62 engages rim 102 of container 100, with rim 102 engaging groove 66, to help hold drinking aid 50 onto container 100. To assemble drinking aid 50 on container 100, the user places drinking aid 50 inside container 100 and bends flexible drinking aid 50 into the position shown in FIG. 7. The elasticity of drinking aid 50 forces rear face 64 of drinking aid 50 to push against the inside wall of container 100. The combination of this spring force with (1) the frictional engagement between drinking aid 50 and container 100, and (2) the mechanical engagement between hook 62 and rim 102 assures assembly of drinking aid 50 on container 100.

With drinking aid 50 in position on and in container 100, the user can tilt container 100 and drink the liquid from container 100. The liquid is centered by drinking aid 50 to allow ease of drinking. Drinking aid 50 funnels the liquid to the center of drinking aid 50, directed by angled arms 56, where the liquid passes through orifice 30, over tongue 58, and to the mouth of the user. Thus, drinking aid 50 creates a funnel to direct fluid flow.

Drinking aid 50 provides a liquid seal when assembled onto rim 102 of container 100, allowing liquid to funnel to V-shaped orifice 60 and preventing leakage between drinking aid 50 and rim 102 of container 100. Thus, like the first embodiment of drinking aid 10, drinking aid 50 constitutes a spill-resistant, rim-mounted, pouring spout for container 100. Also like the first embodiment, drinking aid 50 can be removed from container 100, cleaned, and reused.

In contrast with the second embodiment illustrated as drinking aid 50, no portion of drinking aid 10 sits within container 100. Rather, drinking aid 10 sits atop rim 102 of container 100. Neither embodiment blocks the liquid flow; rather, both embodiments direct or funnel the flow.

Although illustrated and described above with reference to certain specific embodiments, the present invention is nevertheless not intended to be limited to the details shown. Rather, various modifications may be made in the details within the scope and range of equivalents of the claims and without departing from the spirit of the invention.

What is claimed:

1. An apparatus to facilitate drinking consisting essentially of:

a container holding an edible liquid and having a rim defining a substantially horizontal plane and an opening, the container selected from the group consisting of a bowl, cup, and beverage container; and, a drinking aid having a body with a height of at least 0.25 inches, wherein at least a portion of the body defines a U-shaped groove adapted to receive the rim of the container when the rim slips into the groove, with the top of the body engaging the top of the rim, and to create a mechanical engagement between the rim and the drinking aid, the body also engaging the container to create a frictional fit between the drinking aid and the container;

at least one of a column or angled arms disposed on the body to form a V-shaped or U-shaped funnel directing and centering liquid from the container to an orifice either formed in the column or defined by the angled arms; and means to prevent spillage of the liquid from the container when the user tilts the container to pour liquid through the orifice, the drinking aid having a height that extends above the plane of the rim by at least 0.375 inches.

2. The drinking aid according to claim 1 wherein the drinking aid is a single, integral, monolithic unit.

3. The drinking aid according to claim 1 wherein the drinking aid is manufactured from a resilient, flexible, non-toxic material.

4. The drinking aid according to claim 3 wherein the material is polyethylene.

5. The drinking aid according to claim 1 wherein the drinking aid can be removed from the container, cleaned, and reused.

6. The drinking aid according to claim 1 wherein the drinking aid has an annular shape adapted to correspond to that of the container.

7. The drinking aid according to claim 6 wherein the drinking aid extends only partially around the circumference of the container.

8. The drinking aid according to claim 1 wherein the orifice has a width of between one-half and one inch.

9. The drinking aid according to claim 1 wherein the drinking aid is bilaterally symmetrical about the center of the orifice of the drinking aid.

10. An apparatus to facilitate drinking consisting essentially of:

a container holding an edible liquid and having a rim defining a substantially horizontal plane and an opening, selected from the group consisting of a bowl, cup, and beverage container;

a drinking aid having a body with a height of at least 0.25 inches and defining a U-shaped groove adapted to receive the rim of the container when the rim slips into the groove, with the top of the body engaging the top of the rim, and to create a mechanical engagement between the rim and the drinking aid, the body also engaging the container to create a frictional fit between the drinking aid and the container;

a leg extending downward from the body and adapted to engage the outside wall of the container to stabilize the drinking aid on the container;

a neck having a height and extending upward from the body and transitioning to a column that has a height and forms a V-shaped or U-shaped funnel, above the plane defined by the rim, the funnel directing and centering fluid from the container to an orifice centrally formed by angled sides in the column; and a curved lip disposed on the end of the column opposite the neck, the lip having a height and helping to prevent spillage of the liquid from the container when the user tilts the container to pour liquid out the opening and through the orifice, the combined heights of the neck, column, and lip extending above the body by an amount at least 1.5 times the height of the body.

11. The drinking aid according to claim 10 wherein each of the column and lip have a beveled edge.

12. The drinking aid according to claim 10 wherein the drinking aid is a single, integral, monolithic unit.

13. The drinking aid according to claim 10 wherein the drinking aid is manufactured from a resilient, flexible, non-toxic material.

14. The drinking aid according to claim 13 wherein the material is polyethylene.

15. The drinking aid according to claim 10 wherein the drinking aid can be removed from the container, cleaned, and reused.

16. The drinking aid according to claim 10 wherein the drinking aid has an annular shape adapted to correspond to that of the container.

17. The drinking aid according to claim 16 wherein the drinking aid extends only partially around the circumference of the container.

18. The drinking aid according to claim 10 wherein the orifice has a width of between one-half and one inch.

19. The drinking aid according to claim 10 wherein the drinking aid is bilaterally symmetrical about the center of the orifice of the drinking aid.

* * * * *